United States Patent [19]

Newell et al.

[11] 4,202,706

[45] May 13, 1980

[54] CORROSION RESISTANCE TREATMENT OF ALUMINUM WITH N-ALKYL-FLUOROALIPHATICSUL-FONAMIDOPHOSPHONIC ACIDS AND SALTS THEREOF

[75] Inventors: Richard G. Newell, Woodbury; Dale C. Perry, Welch, both of Minn.

[73] Assignee: Minnesota Mining and Manufacturing Company, St. Paul, Minn.

[21] Appl. No.: 19,732

[22] Filed: Mar. 12, 1979

[51] Int. Cl.[2] ..... C25D 11/24; C23F 7/00

[52] U.S. Cl. ..... 148/6.17; 148/6.27; 148/31.5; 204/35 N; 252/389 A; 252/391; 260/944; 260/501.21; 260/502.5; 106/14.12; 252/78.5

[58] Field of Search ..... 260/944, 945, 924, 501.21, 260/502.5; 252/355, 389 A, 390, 391, 80, 78.5; 148/6.17, 6.27, 6.15 R, 31.5; 106/14.12

[56] References Cited

U.S. PATENT DOCUMENTS

| | | | |
|---|---|---|---|
| 3,012,917 | 12/1961 | Riou et al. | 148/6.27 |
| 3,094,547 | 6/1963 | Heine | 260/944 |
| 3,468,725 | 9/1969 | Uhlig | 148/6.15 R |
| 3,630,790 | 12/1971 | Schmidt et al. | 148/6.15 R |
| 3,767,439 | 10/1973 | Moyer et al. | 260/944 |
| 3,870,771 | 3/1975 | Golborn et al. | 260/944 |
| 3,900,370 | 8/1975 | Germscheid et al. | 148/6.15 R |
| 3,911,056 | 10/1975 | Houghton | 260/944 |
| 3,912,654 | 10/1975 | Heid et al. | 252/321 |
| 3,948,819 | 4/1976 | Wilde | 252/545 |
| 3,970,586 | 7/1976 | Schliebs et al. | 260/944 |

*Primary Examiner*—Ralph S. Kendall

*Attorney, Agent, or Firm*—Cruzan Alexander; Donald M. Sell; William G. Ewert

[57] ABSTRACT

The surfaces of articles made of aluminum, such as annodized aluminum and bare aluminum, are treated with N-alkyl-fluoroaliphaticsulfonamidophosphonic acids or salts thereof to impart corrosion resistance to said surfaces.

8 Claims, No Drawings

CORROSION RESISTANCE TREATMENT OF ALUMINUM WITH N-ALKYL-FLUOROALIPHATICSULFONAMIDO-PHOSPHONIC ACIDS AND SALTS THEREOF

This invention relates to the treatment of aluminum surfaces with fluoroaliphatic radial-containing phosphonic acids and the salts thereof. In another aspect, it relates to the treatment of anodized aluminum and bare aluminum surfaces with fluoroaliphaticsulfonamidophosphonic acids, or the salts thereof. In a further aspect, it relates the use of compositions for treating the surfaces of metal articles, such as anodized aluminum automobile bumpers and aluminum radiators, to improve their resistance to corrosion.

There are in the prior art several classes of fluoroaliphatic radical-containing phosphorous acids and the salt and ester derivatives thereof. For example, fluoroalkanephosphonic acids are described in U.S. Pat. Nos. 2,559,754 (Bittles et al), 3,012,917 (Riou et al), 3,630,790 (Schmidt et al), and 3,912,654 (Held et al) and 3,639,144 (Chance et al). Various fluoroaliphatic radical-containing phosphoric acids and phosphates are also known, including certain fluoroaliphatic radical-containing N-alkylsulfonamidoalkanephosphoric acids which are described in U.S. Pat. Nos. 3,094,547 (Heine), 3,911,056 (Houghton) and 3,948,819 (Wilde), and British patent specification No. 1,380,561 (Deem). And U.S. Pat. No. 3,970,586 (Schiebs et al) discloses certain perfluoroalkanesulfonamidoalkanephosphonic and phosphinic acids and their salts. Some of these patents, e.g. U.s. Pat. Nos. 3,012,917, 3,630,790 and 3,911,056, disclose the use of their fluoroaliphatic phosphorus acids or derivatives thereof in the treatment of metal surfaces.

In accordance with the invention, the surfaces of aluminum articles are treated with a liquid treating agent containing N-alkyl-fluoroaliphaticsulfonamidophosphonic acids or the salts thereof. The preferred said acids and salts have the general formula:

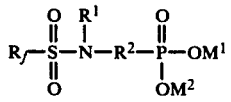

I in which $R_f$ is a monovalent fluorinated aliphatic radical or group containing at least one carbon atom, $R^1$ is a lower alkyl group having 1 to 8, preferably 1 to 6, carbon atoms, $R^2$ is alkylene, $(CH_2)_a$, wherein a is 1 to 16, preferably 3 to 11, or $R^2$ is an alkanetriyl group bonded to $R^1$ and the sulfonamido nitrogen atom to form a azacylic group which has 4 or 5 ring carbon atoms and 1 to 6 exocyclic carbon atoms, and $M^1$ and $M^2$ are preferably hydrogen but can be independently any salt-forming cation, preferably a Group I or Group II metal cation (e.g., the cations of Li, Na, K and Ca), ammonium, or a primary, secondary, tertiary, or quaternary ammonium cation.

In said Formula I, $R_f$ is a monovalent fluorinated aliphatic radical containing at least one carbon atom and preferably a terminal—$CF_3$ group. Where $R_f$ contains a plurality of carbon atoms in a skeletal chain, such chain may be branched or cyclic but preferably is a straight chain. Said skeletal chain of carbon atoms can be interrupted by divalent hetero oxygen or trivalent nitrogen hetero atoms, each of which is bonded only to carbon atoms, but preferably where such hetero atoms are present, such skeletal chain does not contain more than one said hetero atom for every two carbon atoms. An occasional carbon-bonded hydrogen atom, bromine atom, or chlorine atom may be present; where present, however, they preferably are present not more than once for every two carbon atoms in the chain. Thus, the non-skeletal valence bonds are preferably carbon-to-fluorine bonds, that is, $R_f$ is preferably perfluorinated. The total number of carbon atoms of $R_f$ can vary and be, for example, 1 to 18, preferably 1 to 12. Where $R_f$ is or contains a cyclic structure, such structure preferably has 5 to 6 ring member atoms, 1 to 2 of which can be said hetero atoms, i.e., oxygen and/or nitrogen. $R_f$ is also one which is preferably free of ethylenic or other carbon-to-carbon unsaturation, that is, it is a saturated aliphatic or hetrocyclic radical. Examples of $R_f$ radicals are fluorinated alkyl, e.g., $C_4F_{10}$—, and alkoxyalkyl, e.g., $CF_3OCF_2$—, said radicals being preferably perfluorinated straight-chain alkyl radicals, $C_nF_{2n+1}$, where n is 1 to 12.

Representative compounds of Formula I are:

N-Methyltrifluoromethanesulfonamidomethanephosphonic acid;

2-(N-Methyltrifluoromethanesulfonamido)ethanephosphonic acid;

3-(N-Ethylperfluoroethanesulfonamido)propanephosphonic acid;

3-(N-Methylperfluorohexanesulfonamido)propanephosphonic acid;

3-(N-Ethylperfluorododecanesulfonamido)propanephosphonic acid;

3-(N-Ethylperfluorooctadecanesulfonamido)-propanephosphonic acid;

11-(N-Ethylperfluorooctanesulfonamide)undecanephosphonic acid;

6-(N-Methylperfluorobutanesulfonamido)hexanephophonic acid;

3-(N-Ethyl-4-hydroperfluorobutanesulfonamide)-propanephosphonic acid;

3-(N-Methyl-1,1-dihydroperfluorobutanesulfonamido)propanephosphonic acid;

3-(N-Methylperfluorocyclohexanesulfonamido)-propanephosphonic acid;

3-(N-Methyl-1,2-dihydroperfluorobutanesulfonamido)propanephosphonic acid;

3-(N-Methylperfluoroisopropanesulfonamido)-propanephosphonic acid;

1-Perfluoroctaneooctylsulfonyl-4-methylpyrrolidin-3-ylmethanephosphonic acid;

1-Perfluorobutanesulfonylpiperazin-1-ylmethanephosphonic acid;

and the salts of the above listed acids.

Compounds of Formula I wherein $R^2$ is alkylene with 2 to 16 carbon atoms and $M^1$ and $M^2$ are hydrogen can be prepared by hydrolyzing the esters (II) in turn prepared by free radical-catalyzed addition of a dialkyl phosphite to N-alkenyl-fluoroalkanesulfonamides (III, where n is 0 to 14) in accordance with the equation:

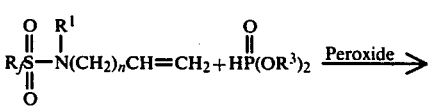

III

-continued

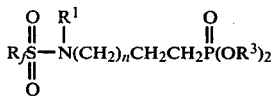

II wherein $R_f$ and $R^1$ are as defined for Formula I, and $R^3$ is alkyl, aryl, or combinations thereof having 1 to 10 carbon atoms. The reaction can be carried out (cf. U.S. Pat. No. 4,067,820) by heating the sulfonamide (III) with an excess of dialkyl phosphite at 100° to 200° C. for several hours while adding portion-wise over the heating period about 1 to 5 percent of a peroxide, such as di-t-butyl peroxide. A preferred method of performing the reaction is to concurrently add a solution of the sulfonamide in dialkyl phosphite and a solution of the peroxide in dialkyl phosphite to the dialkyl phosphite heated to 100° to 200° C. The product (II) is then isolated by distillation at reduced pressure. The sulfonamides (III) are prepared by procedures known in the art, (cf. U.S. Pat. No. 2,803,656).

Compounds of Formula I wherein $R^2$ is methylene can be prepared by hydrolyzing the esters (IV) prepared by the reaction of fluoroaliphatic sulfonamides (V) (such as disclosed in U.S. Pat. No. 2,803,656) with formaldehyde followed by reaction with trialkyl phosphite in accordance with the equations:

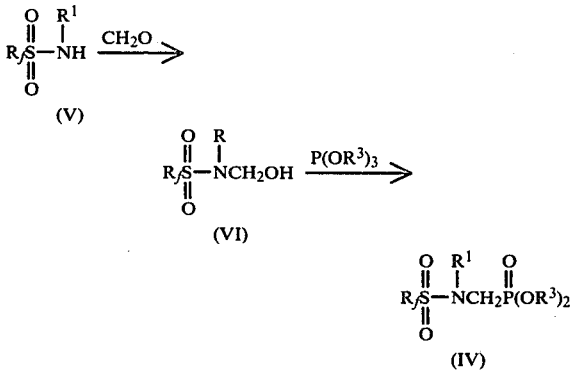

wherein $R_f$, $R^1$ amd $R^3$ are the same as defined above.

A preferred procedure for hydrolysis of the ester precursors of the acids of Formula I involves converting precursor alkanephosphonate esters (VIII) to trimethylsilyl phosphonates by the method described by McKenna et al, *Tetrahedron Letters,* 1977, 155 and then adding water, in accordance with the equations:

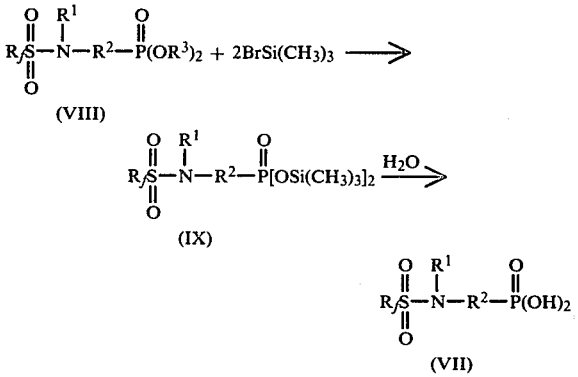

wherein $R_f$, $R^1$, $R^2$ and $R^3$ are as defined above. The conditions of the reactions are mild. Generally, the first reaction is brought about by heating the alkanephosphonate (VIII) with excess bromotrimethylsilane at 20° to 50° C. for 1 to 100 hours. The second reaction is brought about by stirring the product (IX) of the first reaction with excess water at 20° to 50° C. for less than about 6 hours, generally less than 1 hour. The phosphonic acids (VII) are generally isolated from the reaction mixture by filtration or extraction with diethylether, washed, then dried under reduced pressure.

Compounds of Formula I wherein $M^1$ and $M^2$ are salt-forming cations can be prepared by neutralization of the corresponding phosphonic acids by known procedures, i.e., by reaction with 1 or 2 molar equivalents of base, such as the hydroxide, carbonate and acetate of suitable cations. The salts of the phosphonic acids can also be prepared by direct saponification of the corresponding alkyl esters by known procedures.

The term "aluminum" unless otherwise qualified herein, refers to non-alloyed aluminum or to alloys consisting predominately of aluminum, such as those alloys described in "Aluminum Standards and Data", Fifth Edition, January, 1976, The Aluminum Association, Inc. and listed in that text in Tables 1.1 and 1.3, viz., those of the 1000, to 7000 series. As is well known, aluminum surfaces exposed to the air inherently are aluminum oxide surfaces. Such surfaces as well as anodized aluminum surfaces are normally subject to corrosive element in the air or in the environment in which they are used. The treatment of aluminum surfaces, including "bare" aluminum, i.e., non-anodized aluminum surfaces which inherently have a thin oxide layer, as described above, and anodized aluminum, renders such surfaces corrosion resistant.

The corrosion resistant aluminum surface of the metal article is obtained by treating the surface with liquid treating agent containing the N-alkylfluoroaliphaticsulfonamidophosphonic acid or salt. This treatment can be done by coating, spraying or dipping the metal article with a solution containing the phosphonic acid or salt. The solvent can be either organic or aqueous or a mixture of the two, with an aqueous bath being the most preferred. Suitable solvents are materials such as ethanol, ethylene glycol, tetrahydrofuran, butyl cellosolve, ethyl acetate, diisopropylether, acetone, chloroform, toluene, dimethylsulfoxide and water, depending upon the particular phosphonic acid or salt used and the particular aluminum surface to be treated. The concentration of the phosphonic acids or salts in the treating agent is generally 0.001 to 1 weight percent, with the 0.01 to 0.1 percent being preferred. Higher concentration that 1% can be used, although practically these higher concentration are not necessary. The treatment can be done in a temperature range of 25° to 200° C., with the 90° to 100° C. being the optimal treatment temperature for an aqueous treating agent. Where the treating agents is used as a bath, the time required for the treatment can be from several seconds exposure to 30 minute, with 5 to 15 minutes being the most preferred. In the case of anodized aluminum, the preferred method is to immerse the surface of the article is a bath of the phosphonic acid or salt immediately after the last step in the anodizing process (which process is described, for example, in *The Surface Treatment and Finishing of Aluminium and its Alloys* by Wernick et al) and then rinsing and drying the treated surfaces. In the case of a heat exchanger, such as an automobile radiator or solar heating unit made of bare aluminum, the coolant, such as aqueous ethylene glycol, normally circulated in the exchanger can have the phosphonic acid or salt dissolved in the coolant.

Objects and advantages of this invention are illustrated in the following examples. In these examples, the indicated structures of the products made were confirmed by nuclear magnetic resonance and infrared spectral analyses.

EXAMPLE 1

A mixture of N-butyltrifluoromethanesulfonamide (62.0 g, 0.302 mole), potassium carbonate (45.54 g, 0.330 mole) and methanol (250 ml) was refluxed with stirring for two hours. Allyl bromide (39.93 g, 0.330 mole) was then added and this mixture stirred under reflux for 24 hours, cooled, filtered, and the solvent evaporated in vacuo. The residue was fractionally distilled yielding 37.0 g (b.p. of 53°–58° C. at 0.07 torr) of the desired compound, N-allyl-N-butyltrifluoromethylsulfonamide.

Over a 60 minute period, a solution of the above-prepared N-allylsulfonamide (24.60 g, 0.10 mole) and diethylphosphite (15 g) was added dropwise concurrently with a solution of di-t-butyl peroxide (0.90 g) in diethylphosphite (5 g) to diethylphosphite (80 g) being stirred at 150° C. with an argon purge. The resulting mixture was stirred for an additional 1 hour under these conditions. The excess diethylphosphite was distilled at 10–20 torr and the residue fractionally distilled to give 19.64 g (b.p. 150°–153° C. at 0.20 torr) of the desired compound, diethyl 3-(N-butyltrifluoromethanesulfonamido)-propanephosphonate. A mixture of the phosphonate prepared in above (15.36 g, 0.040 mole) and bromotrimethylsilane (13.46 g. 0.088 mole) was stirred under a reflux condensor and calcium chloride drying tube for 96 hours. Then water (75 ml) was added and the resulting mixture stirred for 15 minutes followed by extraction with three 50 ml portions of diethylether. The ether portions were combined, dried with $MgSO_4$ and evaporated in vacuo to give 12.25 g of the desired compound, 3-(N-butyltrifluoromethanesulfonamidopropanephosphonic acid.

EXAMPLE 2

The procedure of Example 1 was repeated with the exception that N-ethylperfluorobutanesulfonamide was used in place of N-butyltrifluoromethanesulfonamide to make N-allyl-N-ethylperfluorobutanesulfonamide (b.p. 50°–55° C. at 0.12 to 0.10 torr). The latter was reacted with diethylphosphite to produce the desired compound, diethyl 3-(N-ethylperfluorobutanesulfonamido)-propanephosphonate (b.p. 148°–152° C. at 0.4–0.5 torr). A solution of the phosphonate prepared in Example 3 (30.0 g, 0.062 mole) and bromotrimethylsilane (20.0 g, 0.130 mole) was stirred under a reflux condensor and calcium chloride drying tube for 24 hours, water (75 ml) was added, and then mixture stirred for 15 minutes. The resulting white precipitate was filtered and washed with water (50 ml) and diethylether (100 ml), then dried in an oven at 100° C. for 24 hours at 10–20 torr, to yield the desired compound, 3-(N-ethylperfluorobutanesulfonamido)propanephosphonic acid (m.p. 138.5°–140° C.).

EXAMPLE 3

Following the procedure of Example 1, starting with N-ethylperfluorooctanesulfonamide, diethyl 3-(N-ethylperfluorooctanesulfonamide)propanesphosphonate (b.p. 170°–173° C. at 0.05 torr) was made. The latter was hydrolyzed according to the procedures of Example 2 to produce the corresponding phosphonic acid (m.p. 146°–151° C.).

EXAMPLE 4

Following the bromination procedure described by L. H. Smith, *Org. Synthesis,* Coll. Vol. 3, p. 193, a solution of chloroform (20 ml) and phosphorous tribromide (31.67 g, 0.119 mole) was cooled to −10° C. with an ice-salt bath. Over a 15-minute period, dry pyridine (5.11 ml) was added to this solution while stirring the resulting mixture. A solution of 4-(N-methylperfluorooctyloctanesulfonamido)-butanol (193.00 g, 0.330 mole), chloroform (200 ml) and dry pyridine (1.49 ml) was added dropwise over a 2-hour period. The reaction mixture was stirred for another 1.5 hours at 0 to −10° C., then at room temperature for 36 hours. The mixture was extracted with three 75 ml portions of cold (0° C.) concentrated sulfuric acid. Anhydrous potssium carbonate was added to the extracted solution, the mixture stirred overnight at room temperature and then filtered and evaporated in vacuo. The resulting solid residue was recrystallized from chloroform/petroleum either (30°–75° C. b.p.) to give 109.80 g of 1-bromo-4-(N-methylperfluorooctanesulfonamido)butane.

Following the procedures of L. Maier et al, *Organic Phosphorus Compounds,* Vol. 7, John Wiley & Sons, New York, 1976, p. 23, a mixture of above-prepared bromide (32.40 g. 0.05 mole) and triethylphosphite was stirred at 150°–155° C. for 4 hours, afterwhich the volatile materials present were removed by distillation at 100°–105° C. at 0.20 torr. The residue was stirred for 16 hours at room temperature under a calcium chloride drying tube with bromotrimethylsilane (16.83 g, 0.11 mole). To this mixture 75 ml of water was added, followed by stirring for 5 minutes. The resulting white precipitate was filtered, washed twice with 100 ml portions of water and three times with 100 ml portions of diethyl ether. After drying at 80° C. at 10–20 torr for 4 hours, 19.33 g of 4-(N-methylperfluorooctanesulfonamido)butane phosphonic acid (m.p. 150°–163° C.) was obtained.

EXAMPLE 5

Starting was 11-(N-ethylperfluorooctanesulfonamido)undecanol and utilizing the procedures described in Example 4, 11-(N-ethylperfluorooctanesulfonamido)undecanephosphonic acid (m.p. 77°–88° C.) was prepared.

EXAMPLE 6

Following the procedure described in Example 1, N,N-diallylperfluorooctanesulfonamide was reacted with diethylphosphite. As a result of an internal cyclization, the product obtained was diethyl 1-perfluorooctylsulfonyl-4-methylpyrroliden-3- ylmethanephosphonate (b.p. 165°–167° C. at 0.22 torr). The latter product was hydrolyzed according to the procedure of Example 2 produce the corresponding acid (m.p. 150°).

EXAMPLE 7

Following the procedure of Example 1, N-allyl-N-ethyltrifluoromethanesulfonamide (b.p. 395° C. at 1.50–0.35 torr) was reacted with diethylphosphite to produce diethyl 3-(N-ethyltrifluoromethanesulfonamido)propanephosphonate (b.p. 147°–155° C. at 0.25 torr). Following the procedure of Example 2, this phosphonate was hydrolyzed to produce the corresponding phosphonic acid (m.p. 137.5°-139.5° C.).

EXAMPLE 8

Following the procedure of Example 1, N-allyl-N-butylperfluorooctanesulfonamide was converted to diethyl 3-(N-butylperfluorooctanesulfonamido)-propanephosphonate (b.p. 185°-200° C. at 0.10 torr). This latter compound was converted to the corresponding phosphonic acid (m.p. 51°-58° C.) by the procedure described in Example 2.

EXAMPLE 9

In each of three runs, aluminum panel (Al 5352, widely anodized for use as automotive bright trim) was given the usual treatment sequence for anodizing: mirror-polished; alkaline-cleaned; desmutted; bright-diped; desmutted; and anodized in 15% $H_2SO_4$ at 21° C., 1 ampere/decimeter$^2$, to produce a 7.5-micron thick oxide layer. Each step, except polishing, was followed by a thorough rinse with deionized water. A panel so prepared was then sealed by immediately submerging the panel for 15 minutes in a sealing bath of boiling deionized water containing 0.05 g/l of a phosphonic acid of this invention.

Corrosion resistance of the sealed panel was determined by measuring the weight loss according to the conventional acid dissolution test (ADT), the lower the weight loss the better the seal. The loss is measured after 15 minutes submersion at 37° C. in an acid bath containing 2% chromic acid and 3% phosphoric acid. ADT results are given in the table below along with, for purposes of comparison, the results obtained with a sealing bath containing no sealing bath additive and a sealing bath containing 0.5 g/l. with $C_6F_{17}SO_2NH(CH_2)_3P(O)(OH)_2$, to show the superior results obtained with the sealing agent of this invention (Run 2)

| Run | Sealing Bath Additive | ADT Loss, mg/dm$^2$ |
|---|---|---|
| 1* | None | 42.6 |
| 2 | $C_8F_{17}SO_2NH(CH_2)_3P(O)(OH)_2$ | 19.0 |
| 3 | $C_8F_{17}SO_2N(C_2H_5)(CH_2)_3P(O)(OH)_2$ | 5.0 |
| 4 | $C_8F_{17}SO_2N(CH_3)(CH_2)_4P(O)(OH)_2$ | 4.0 |
| 5 | 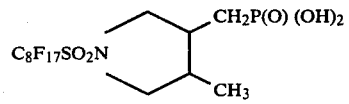 | 0 |

*In this control run, the "sealing" step used was merely submerging for 15 minutes in boiling deionized water.

EXAMPLE 10

A freshly cleaned bare aluminum panel (Al 7072, typical of that used in the fabrication of aluminum radiators for automobiles) was immersed for about one hour at 25° C., in a bath of 50 vol.% aqueous ethylene glycol solution containing 0.1 wt.% $C_8F_{17}SO_2N(C_2H_5)(CH_2)_3P(O)(OH)_2$ dissolved therein. The bath contained "corrosive" water, viz., one hundred times the chloride, sulfate, and bicarbonate concentration specified in ASTM D 1384. During the immersion, the corrosion rate was measured by the linear polarization method, an electrochemical technique well-known to those skilled in the art of metal protection. As explained in detail by F. Mansfield in *Adv. Corr. Sci. Technol.* 6, 163 (1976), one can use this method to measure the current generated during a corrosion process. The magnitude of that corrosion current—denoted by $i_{corr}$ and expressed as a current density, in amperes per unit area—is directly proportional to the corrosion rate. Thus the action of an effective corrosion inhibitor is reflected by a reduced value for $i_{corr}$ in its presence. The polarization was run under nitrogen at 25° C. For purposes of comparison, another bare aluminum panel (Al7072) was similarly immersed in an aqueous ethylene glycol bath which did not contain any corrosion inhibitor, and the corrosion rate was likewise determined by polarization. Results are set forth in the table below:

| Run | Corrosion Inhibitor | $i_{corr}$ μa/cm$^2$ |
|---|---|---|
| 1 | None | 3.6 |
| 2 | $C_8F_{17}SO_2N(C_2H_5)(CH_2)_3P(O)(OH)_2$ | 0.3 |

Various modifications and alterations of this invention will become obvious to those skilled in the art without departing from the scope of this invention.

What is claimed is:

1. A method of treating aluminum surfaces to improve the corrosion resistance thereof which comprises contacting said surfaces with a liquid containing an N-alkyl-fluoroaliphaticsulfonamidophosphonic acid or the salt thereof.

2. A method of treating the surfaces of an aluminum article to improve the corrosion resistance thereof which comprises contacting said surface with a solution of an N-alkyl-fluoroaliphaticsulfonamidophosphonic acid or the salt thereof, said acid and salt having the general formula:

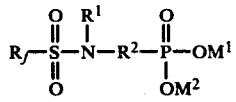

in which $R_f$ is a monovalent fluoroaliphatic radical having at least one carbon atom, $R^1$ is an alkyl group having 1 to 8 carbon atoms, $R^2$ is an alkylene group with 1 to 16 carbon atoms or $R^1$ together with $R^2$ and the sulfonamido nitrogen forming an azacyclic ring, and $M^1$ and $M^2$ are independently hydrogen or salt-forming cations.

3. A method of treating the surface of an anodized aluminum of bare aluminum article to improve the corrosion resistance of said surface, which method comprises contacting said surface with a treating agent comprising an aqueous solution containing 0.001 to 1 weight percent of a compound having the general formula:

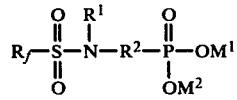

in which $R_f$ is a monovalent fluoroaliphatic radical having 1 to 18 carbon atoms and a terminal —$CF_3$ group, $R^1$ is an alkyl group having 1 to 6 carbon atoms, $R^2$ is an alkylene group with 3 to 11 carbon atoms, and $M^1$ and $M^2$ are independently hydrogen or salt-forming cations selected from the group consisting of Group I or Group II metal cations, ammonium, or a primary, secondary, tertiary, or quaternary ammonium cation.

4. The method according to claim 3 wherein said compound is selected from the group consisting of diethyl 3-(N-butyltrifluoromethanesulfonamido)-propanephosphonate, 3-(N-butyltrifluoromethylsulfonamido)-propanephosphonic acid, diethyl 3-(N-ethylperfluorobutanesulfonamido)-propanephosphonate, 3-(N-ethylperfluorobutranesulfonamido)propanephosphonic acid, 4-(N-ethylperfluorooctanesulfonamido)propanephophonic acid, 4-(N-methylulperfluorooctanesulfonamido)butane phosphonic acid, 3-(N-ethyltrifluorosulfonamido)propanephosphonic acid, 3-(N-ethyltrifluoromethanesulfonamido)propanephosphonic acid, and 3-(N-butylperfluorooctanesulfonamido)propanephosphonic acid.

5. The method according to claim 4 wherein said article is a heat exchanger of bare aluminum and said aqueous solution is an aqueous ethylene glycol solution circulated in said heat exchanger as a heat exchange medium.

6. The method according to claim 4 wherein said surface is that of an anodized aluminum article, said treating agent is a sealing bath of said aqueous solution in which said surface is immersed to impart said corrosion resistance and then is withdrawn from said bath, rinsed with water, and dried.

7. The method according to claim 6 wherein said compound is $C_8F_{17}SO_2N(C_2H_5)(CH_2)_3P(O)(OH)_2$.

8. An aluminum article the surface of which is treated with an N-alkyl-fluoroaliphaticsulfonamidophosphonic acid or salt thereof.

* * * * *

UNITED STATES PATENT AND TRADEMARK OFFICE

CERTIFICATE OF CORRECTION

PATENT NO. : 4,202,706

DATED : May 13, 1980

INVENTOR(S) : Richard G. Newell and Dale C. Perry

It is certified that error appears in the above—identified patent and that said Letters Patent is hereby corrected as shown below:

Col. 1, l. 53: "azacylic" should read -- azacyclic --.

Col. 6, l. 24: "either" should read -- ether --.

Col. 6, l. 46: "was" should read -- with --.

Col. 8, l. 45: "forming" should read -- form --.

Col. 9, l. 9: "ethylperfluorobutranesulfonamido" should read -- ethylperfluorobutanesulfonamido --.

Col. 9, l. 13: "methylulperfluorooctanesulfonamidö" should read -- methylperfluorooctanesulfonamido --.

Signed and Sealed this

*Twenty-ninth* Day of *July 1980*

[SEAL]

*Attest:*

SIDNEY A. DIAMOND

*Attesting Officer*

*Commissioner of Patents and Trademar*